US009455099B2

(12) United States Patent
Freyermuth et al.

(10) Patent No.: US 9,455,099 B2
(45) Date of Patent: Sep. 27, 2016

(54) POWER-SWITCH WITH INTERNAL VOLTAGE MEASUREMENT

(71) Applicants: Thomas Freyermuth, Kalenborn (DE); Georg Reidt, Swisttal (DE); Ireneusz Scislak, Cologne (DE); Andreas Gisbrecht, Meckenheim (DE); Marc Suchalla, Duisburg (DE); Rainer Schmidt, Sankt Augustin (DE); Alexander Zumbeck, Bornheim (DE)

(72) Inventors: Thomas Freyermuth, Kalenborn (DE); Georg Reidt, Swisttal (DE); Ireneusz Scislak, Cologne (DE); Andreas Gisbrecht, Meckenheim (DE); Marc Suchalla, Duisburg (DE); Rainer Schmidt, Sankt Augustin (DE); Alexander Zumbeck, Bornheim (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 53 days.

(21) Appl. No.: 14/355,225

(22) PCT Filed: Nov. 2, 2012

(86) PCT No.: PCT/EP2012/071719
§ 371 (c)(1),
(2) Date: Apr. 30, 2014

(87) PCT Pub. No.: WO2013/064630
PCT Pub. Date: May 10, 2013

(65) Prior Publication Data

US 2014/0318936 A1 Oct. 30, 2014

(30) Foreign Application Priority Data

Nov. 2, 2011 (EP) ..... 11187493

(51) Int. Cl.

| | |
|---|---|
| ***H01H 67/02*** | (2006.01) |
| ***H01H 9/00*** | (2006.01) |
| ***H01H 71/12*** | (2006.01) |
| ***H01H 71/74*** | (2006.01) |
| *H01H 47/00* | (2006.01) |

(52) U.S. Cl.
CPC ..... *H01H 9/0016* (2013.01); *H01H 71/125* (2013.01); *H01H 71/7409* (2013.01); *H01H 47/002* (2013.01)

(58) Field of Classification Search
CPC ..... H01H 83/04
USPC ..... 335/6, 131
See application file for complete search history.

(56) References Cited

U.S. PATENT DOCUMENTS

| | | | | |
|---|---|---|---|---|
| 4,958,135 | A * | 9/1990 | Baginski | H01H 71/1045 335/8 |
| 7,554,781 | B1 * | 6/2009 | Weeks | H01H 3/001 335/15 |
| 8,358,188 | B2 * | 1/2013 | Bellotto | H01H 71/7409 335/202 |
| 2003/0048589 | A1 * | 3/2003 | Tignor | H02H 3/006 361/93.3 |
| 2009/0190289 | A1 * | 7/2009 | Bellotto | H01H 71/7409 361/620 |
| 2009/0325423 | A1 | 12/2009 | Bollinger et al. | |

FOREIGN PATENT DOCUMENTS

| | | | |
|---|---|---|---|
| EP | 2079091 | A1 | 7/2009 |
| FR | 2794281 | A1 | 12/2000 |
| WO | WO 2008034395 | A1 | 3/2008 |
| WO | WO 2008034396 | A1 | 3/2008 |

* cited by examiner

*Primary Examiner* — Alexander Talpalatski
(74) *Attorney, Agent, or Firm* — Leydig, Voit & Mayer, Ltd.

(57) ABSTRACT

A power-switch having a switch housing and an electronic module, at least one contact being provided to tap a voltage at a primary conductor, and an adapter being provided to reduce the tapped voltage of said primary conductor.

10 Claims, 6 Drawing Sheets

POWER-SWITCH WITH INTERNAL VOLTAGE MEASUREMENT

CROSS-REFERENCE TO RELATED APPLICATIONS

This application is a U.S. National Stage Application under 35 U.S.C. §371 of International Application No. PCT/EP2012/071719, filed on Nov. 2, 2012, and claims benefit to European Patent Application No. EP 11187493.9, filed on Nov. 2, 2011. The International Application was published in German on May 10, 2013, as WO 2013/064630 A1 under PCT Article 21(2).

FIELD

The invention relates to a circuit breaker with a breaker housing and with an electronics module, wherein at least one contact is provided for tapping a voltage at a primary line.

BACKGROUND

For a power measurement at a circuit breaker, for example for an energy consumption analysis, a voltage tap is required. Up until now, an external device outside the circuit breaker was used for this purpose. In order to be able to perform the power measurement inside the breaker itself, an internal voltage tap inside the breaker is also necessary. A circuit breaker is known from document US 2009/0190289 A1 wherein a voltage tap is incorporated into the circuit breaker itself, so that an external module can be dispensed with. Tapping such a high voltage as that present in a primary line of a circuit breaker requires a reduction in the voltage with the help of voltage dividers to a value tolerable by electronic measurement gear. Carrying the high-voltage signal over traces, lines, adapters and contacts brings about problems due to fouling, high temperatures, possible leakage paths and disruptive influences on the electronics due to electrical or electromagnetic effects. Moreover, there is the problem of providing sufficient space for additional elements inside a breaker housing.

SUMMARY

One aspect of the invention provides a circuit breaker with internal voltage tapping that is improved with regard to the problems mentioned.

An aspect of the invention provides a circuit breaker, comprising: a breaker housing; an electronics module; a contact configured to tap a voltage at a primary line; and an adapter configured to reduce a tapped voltage of the primary line, wherein the adapter is provided inside the breaker housing, and wherein the adapter is positioned outside the electronics module.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
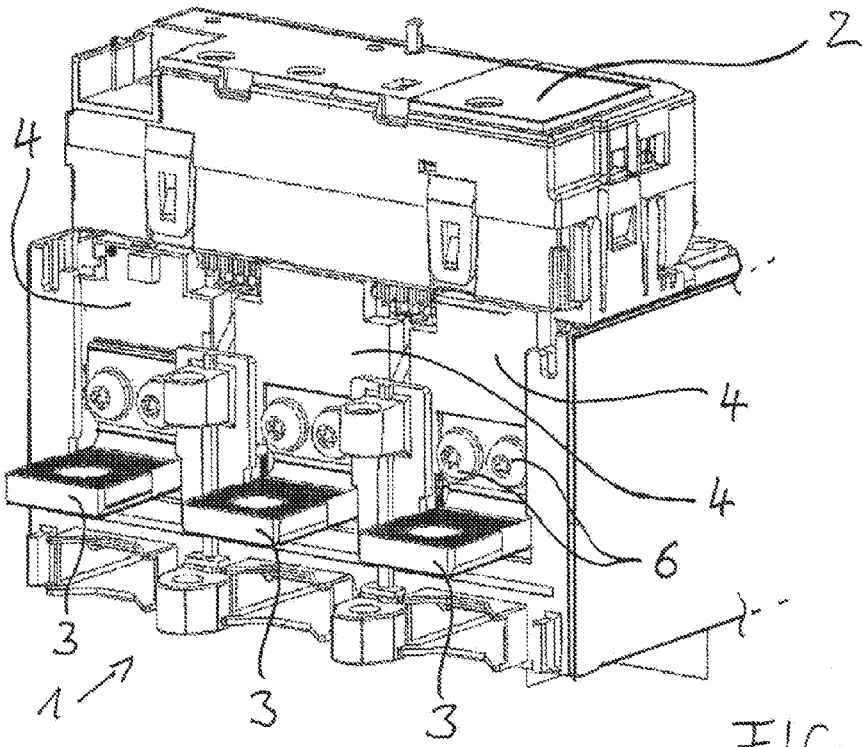
FIG. 1, an embodiment of a three-pole circuit breaker according to the invention.

The circuit breaker according to an aspect of the invention has a breaker housing and an electronics module. The breaker housing for the purpose of the invention constitutes the outer boundary of the circuit breaker and contains all important components. Thus a separate converter housing, if present, is included in the breaker housing. The electronics module includes essentially the electronics controlling the breaker, as well as sensing electronics for evaluating the voltage of a primary line, reduced by voltage dividers, which according to the invention is tapped by at least one contact on the primary line. According to the invention, an adapter is provided inside the breaker housing for reducing the tapped voltage of the primary line, this adapter being positioned outside the electronics module. Advantageously, the circuit breaker according to the invention makes it possible to place the adapter sufficiently far and/or sufficiently shielded from the electronics module so that a disruptive effect on the electronics from electrical or electromagnetic effects of the high voltage can be considerably reduced. Here, the designation of electronics module refers to electronic components of a circuit breaker grouped on one or more circuit boards, which as a rule also includes a housing of its own for the electronic components. According to the invention, the reduction of the tapped voltage is accomplished outside the electronics module.

According to one preferred embodiment, the adapter is provided with a contact plate which is connected, particularly in a releasable manner, to the primary line as a contact for voltage tapping. It is particularly preferred for the contact plate, together with the primary line, to be attachable to the breaker housing using fasteners. The fasteners are usually screws which are used for fastening the primary line. The contact plate can be advantageously fastened jointly, without requiring any change to the circuit breaker to be accomplished. The fastening screws need not be replaced, as the contact plate in particular has a material thickness that is extremely small compared to the primary line.

Due to its stability, however, the contact plate makes possible another advantageous embodiment, according to which the adapter can be fastened to the breaker housing exclusively by the contact plate. The question of positioning the adapter inside the breaker housing is thereby advantageously answered. This embodiment is clearly particularly well suited to retrofitting an already existing design of a circuit breaker. Moreover, the embodiment is optimized with regard to electromagnetic compatibility (EMC), as no high-voltage-carrying traces at all, from the contact with the primary line on, need be routed through the breaker housing.

A second preferred embodiment provides that the adapter is connected with the contact for the voltage tap on the primary line through a trace. Here, the printed circuit in particular is routed through the breaker housing shielded and/or separated from the electronics module in order to minimized electromagnetic interaction. This embodiment has the advantage that the available free spaces within the breaker housing can be used for positioning the adapter. Besides, several adapters can be grouped in one position for a multi-pole breaker.

According to a third preferred embodiment, it is provided that the adapter has a contact element, it being possible to establish contact for the voltage tap at the primary line through the contact element. According to this embodiment, some freedom is advantageously offered with respect to positioning of the adapter. This is limited only by the requirement that the primary line must be contactable through the contact element. With regard to EMC, it is also advantageous to note that in this third embodiment no high-voltage-carrying traces need be routed through the breaker housing. According to one configuration of the third embodiment, it is provided that the contact element has a spring or is configured as a spring, tolerance compensation in contacting being advantageously afforded thereby.

According to another preferred embodiment, which is applicable in particular to the second and third embodiments, it is provided that the adapter is positioned in a side wall of the breaker housing. Inasmuch as existing circuit breaker designs generally have little usable free space, use of the wall regions would be advantageous, provided that the stability and protective function continues to be ensured. It is particularly preferred to position the adapter in the side wall of the breaker housing through which the primary line is routed into the breaker housing. This again makes possible the previously described use of contact elements, or at least requires only a short trace for the high voltage.

In a multi-pole circuit breaker, it is provided in particular that a plurality of primary lines is assigned a corresponding number of adapters, so that an internal voltage tap of all lines is advantageously possible. Here, depending on the embodiment, each adapter can have a separate adapter housing. Alternatively, the plurality of adapters can be placed in a common collective adapter housing outside the electronics module.

The invention will be described in further detail below based on one embodiment, with the help of diagrams. The designs are exemplary and do not restrict the general concept of the invention FIGS. 1 through 3 refer to a first embodiment of a circuit breaker according to the invention. In FIG. 1 is shown a partial view of circuit breaker 1, within which is located a transducer of the circuit breaker. The transducer not visible inside the housing 1 in the illustrated exemplary embodiment can have its own transducer housing in modified designs of circuit breakers, which is for example positioned outside on the actual breaker housing 1. For the purpose of the invention, in this case the transducer housing should also be considered part of the breaker housing. Primary lines 3 lead inside the breaker housing 1, extend through the transducer block and then run onward into the actual switch chamber (not shown) of the circuit breaker. The primary lines 3 are fastened to the transducer using fasteners 6, usually screws. An electronics module 2 is positioned on the transducer The electronic circuits placed inside it serve for controlling the circuit breaker on the basis of the signals transmitted by the transducer.

Figure 2:
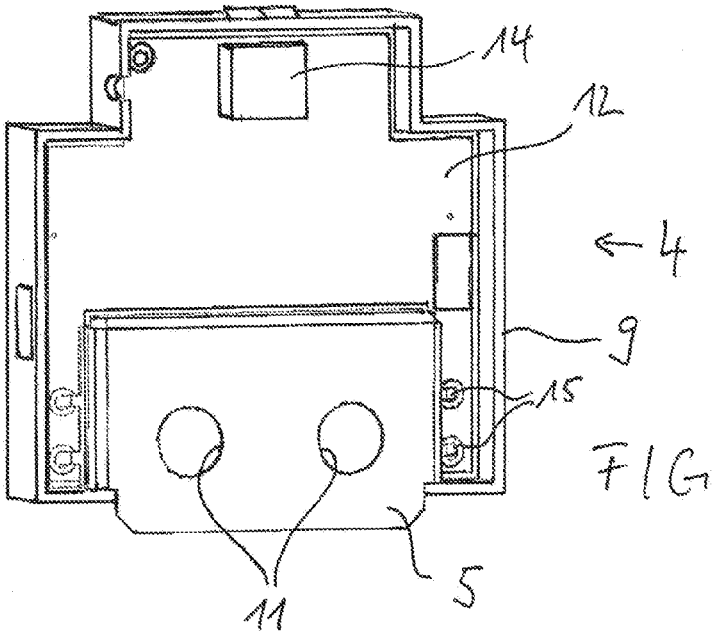
FIG. 2, a detailed view of an adapter corresponding to the embodiment of FIG. 1.
Figure 3:
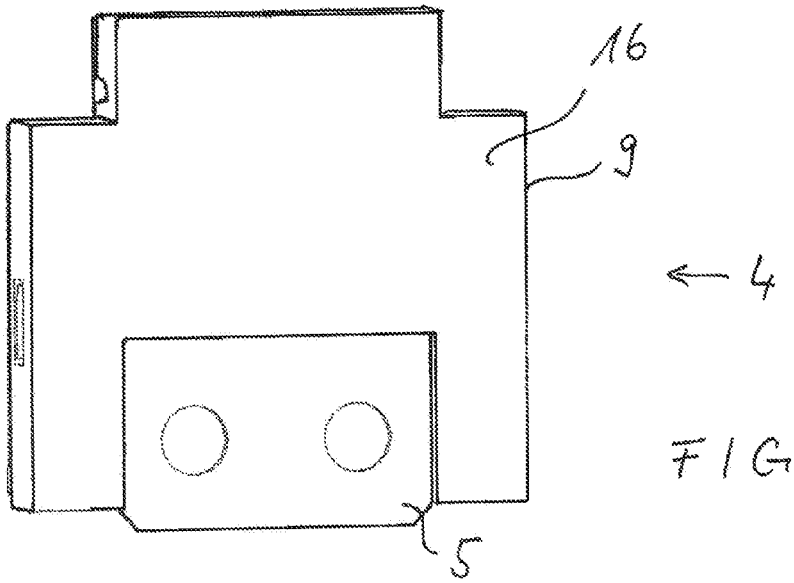
FIG. 3, the adapter according to FIG. 2 with cover.

According to the invention, the circuit breaker has at least one contact for tapping a voltage at one of the primary lines 3. Three adapters 4 are provided here within transducer 1 for reducing the tapped voltages of the three primary lines 3. FIGS. 2 and 3 show one of the adapters 4 in detail, without an adapter cover 16 in FIG. 2 and with an adapter cover 16 in FIG. 3. The reduction in voltage is accomplished by means of voltage dividers 14. The resistors provided for this purpose are placed on a circuit board 12 inside an adapter housing 9. Moreover, a contact plate 5 is fastened to the circuit board 12 through contact pins 15. The adapters 4 are positioned outside the electronics module 2 according to the invention, so as to reduce interference with the electronics by electrical or electromagnetic effects. The adapters 4 are fastened to the primary lines 3 by means of the contact plates 5 by fasteners 6, so that contact between the primary lines 3 and the adapters 4 is securely established. The adapter 4 is additionally shielded by the adapter housing 9 and the adapter cove 16, thereby increasing electromagnetic compatibility (EMC). The reduced voltage signal is transmitted, by means of conducting traces for example, to the electronics block 2, and processed there.

Figure 4:
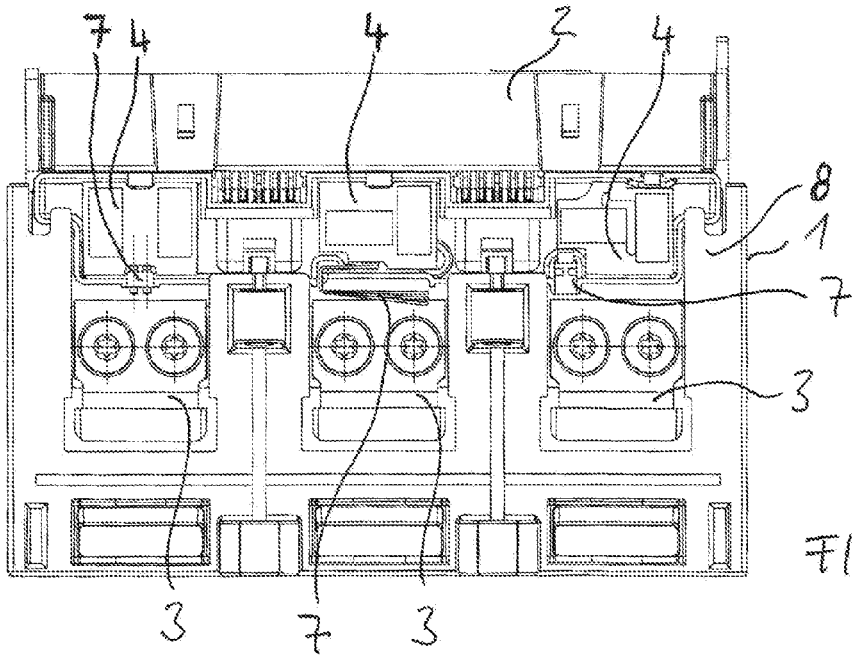
FIG. 4, another embodiment of the circuit breaker according to the invention with three different exemplary embodiments of a contact element.
Figure 4A:
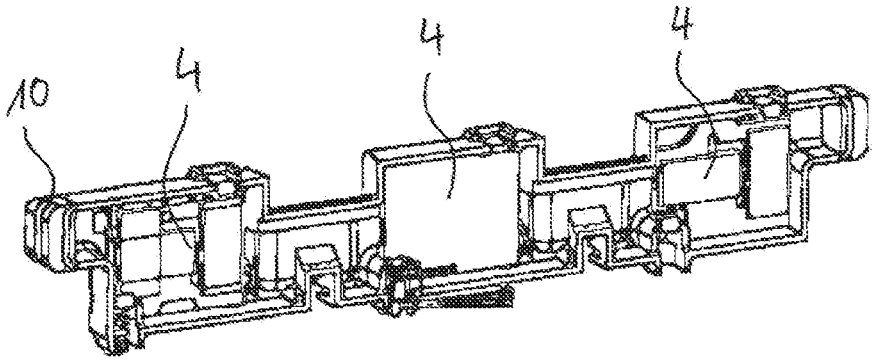
FIG. 4A, a collective adapter housing for accommodating the adapters according to FIG. 4.

In FIG. 4, another embodiment of the circuit breaker according to the invention is shown in partial view. The side wall 8 of the circuit breaker housing 1 can be distinguished, through which the primary lines 3 are routed into the circuit breaker housing 1. The embodiment illustrates a variant of positioning of the adapters 4, which here are positioned inside the side wall 8, preferably in a common collective adapter housing 10 which is shown individually in FIG. 4*a*. To this end, the side wall 8 is shown partially broken open. This position is especially advantageous, as contact can be made with the primary lines 1 through its surface or through fasteners of the primary lines. To this end, the side wall 8 can have suitable channels or bores between the adapters 4 and the primary lines 3. In addition, the reduced voltage signal can be routed directly to the electronics module 2, as will be explained hereafter in connection with FIGS. 5, 6 and 7. The various adapters 4 serve here only to illustrate possible exemplary embodiments. Usually, adapters 4 of the same type are used in a circuit breaker.

Figure 5:
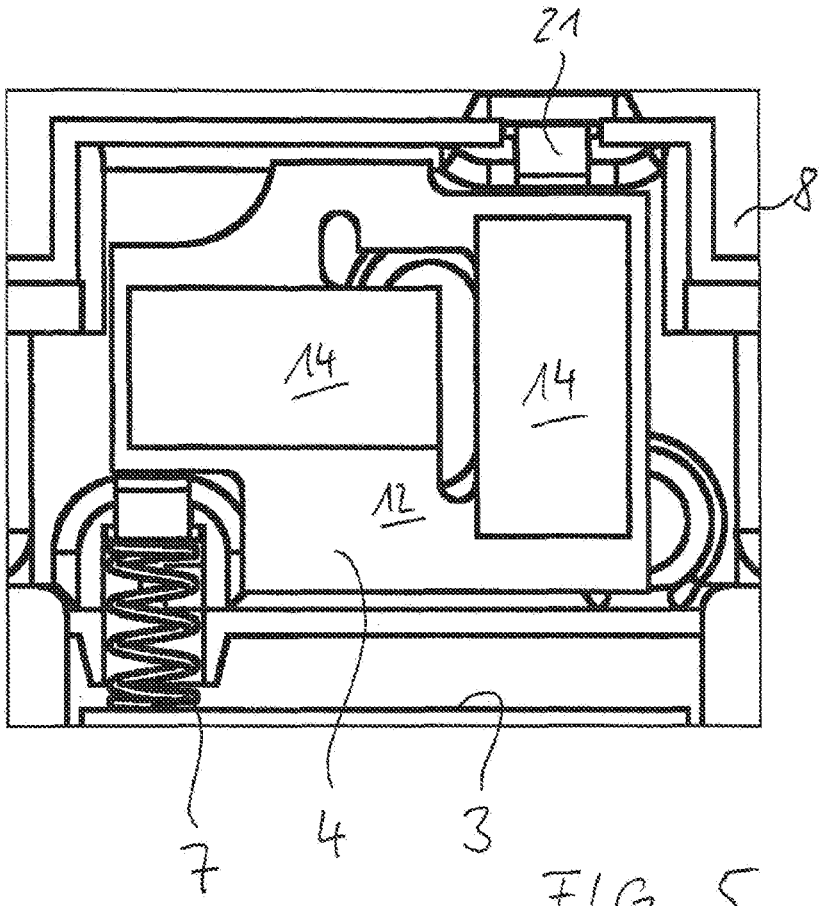
FIG. 5, a contact element according to FIG. 4 in detail.
Figure 6:
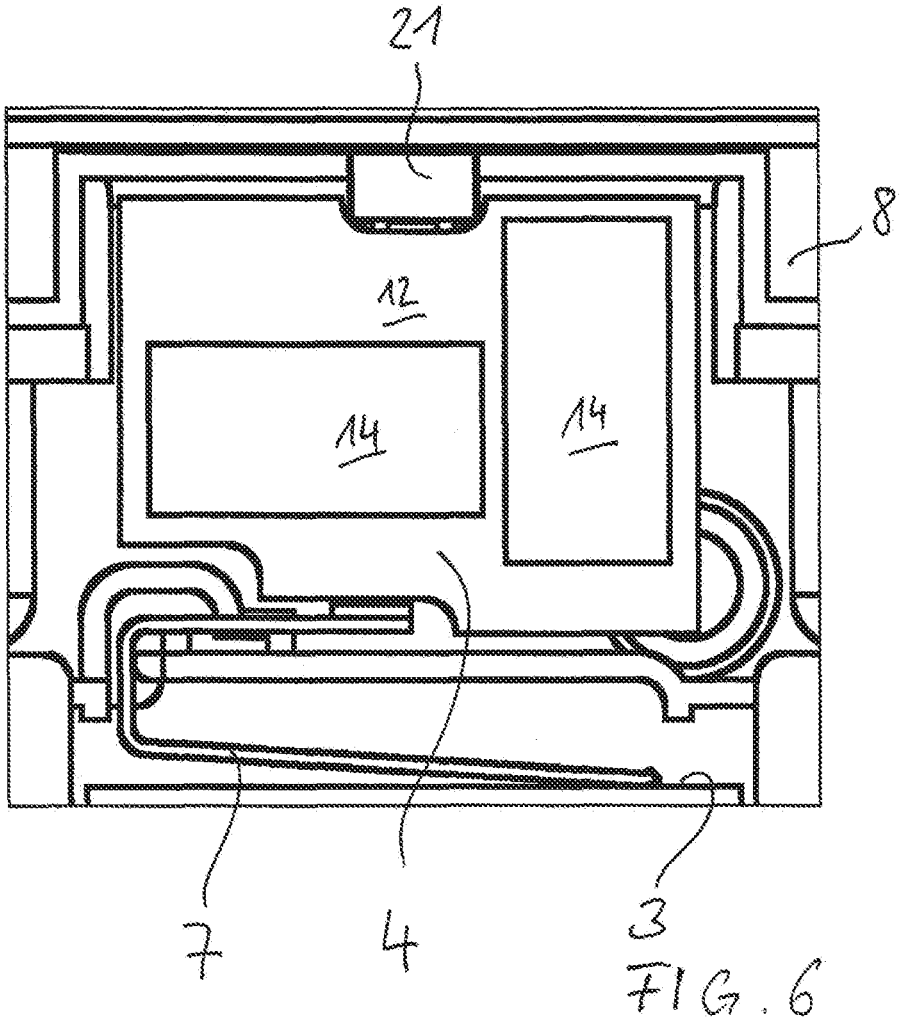
FIG. 6, another contact element according to FIG. 4 in detail.
Figure 7:
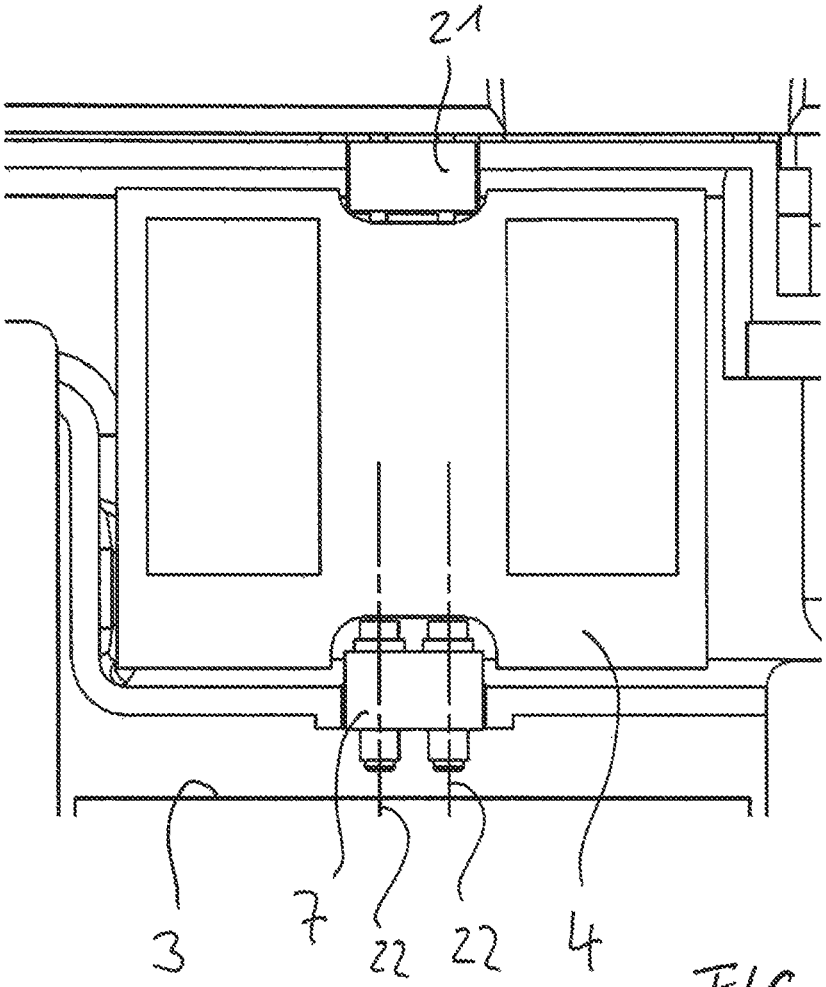
FIG. 7, still another contact element according to FIG. 4 in detail.

One adapter 4 as in FIG. 4 is illustrated in detail in each of FIGS. 5, 6 and 7. The adapters 4 are essentially distinguished by their contact elements 7, which constitute the contacts to the respective primary lines 3. Aside from that, voltage dividers 14 are shown by way of example on the respective circuit board 12 of the adapters 4.

The contact element 7 according to FIG. 5 includes a compression spring fastened and connected to the circuit board 12 in the form of a spiral which is pre-loaded against the surface of the primary line 3 or against a mounting screw of the primary line 3 and transmits the high voltage from the primary line 3 to the adapter 4.

The contact element 7 according to FIG. 6 includes a leaf spring fastened and connected to the circuit board 12, which is pre-loaded against the surface of the primary line 3 or against a mounting screw of the primary line 3 and transmits the high voltage from the primary line 3 to the adapter 4.

The contact element 7 according to FIG. 7 includes a so-called spring-load contact fastened and connected to the circuit board 12, the two telescoping contact rods 22 whereof in particular are pre-loaded by spring force against the surface of the primary line 3 or against a mounting screw of the primary line 3 and transmit the high voltage from the primary line 3 to the adapter 4. The location of the contact rods 22 is shown only by lines.

Similar contact elements 7 can also be used for transmitting the reduced voltage signal to the electronics module 2. The contacts to the electronics module are designated in FIGS. 5 through 7 with the reference symbol 21.

Figure 8:
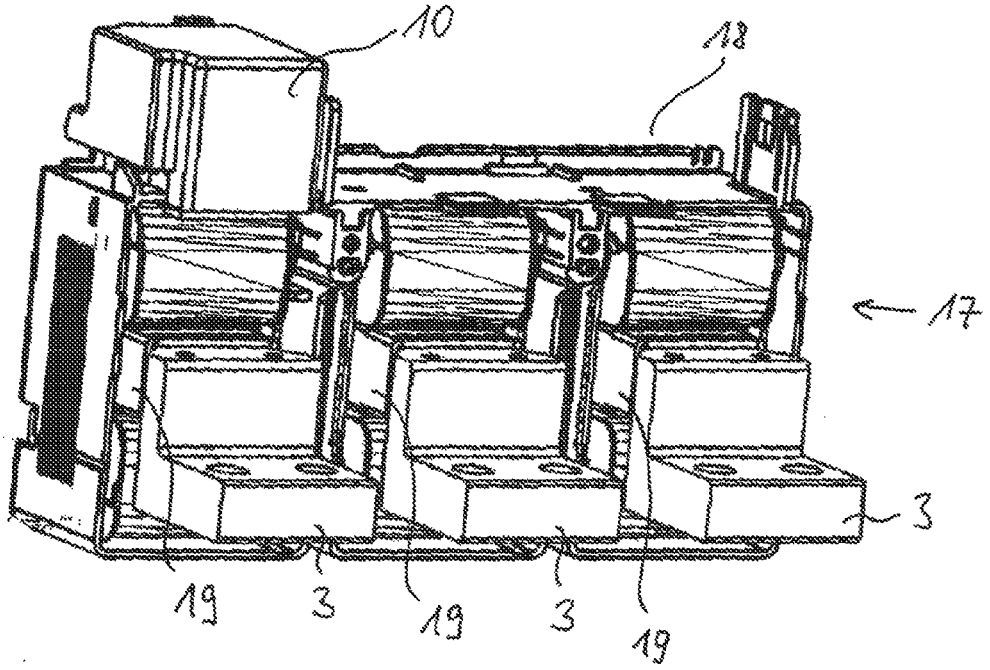
FIG. 8, another embodiment of the circuit breaker according to the invention.
Figure 9:
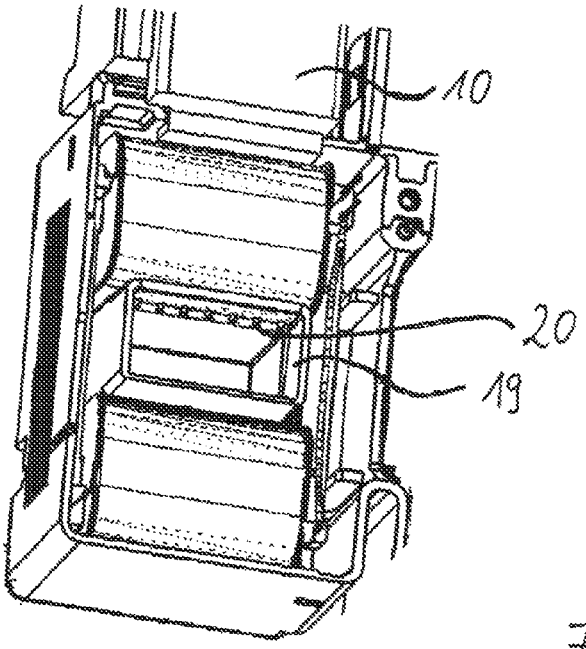
FIG. 9, a detail of the embodiment of FIG. 8.

FIGS. 8 and 9 show another embodiment of the circuit breaker according to the invention. The transducer 17 is shown in FIG. 8 without the breaker housing 1. A socket 18 is prepared for insertion of the electronics module 2. Moreover, a potting compound is not shown for better perceptibility, so that slots 19 can be seen through which the primary lines 3 are inserted. One cushioned cam contact 20 only is visible in the detail view of FIG. 9, in which the primary line 3 is also omitted. Contact is formed permanently during mounting of the primary line 3 in the transducer 17. The adapters 4 for reducing voltage are located, in the embodiment shown, in a collective adapter housing 10 and are connected with the cushioned cam contacts 20 through traces, not shown.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE SYMBOLS

1 Breaker housing
2 Electronics module
3 Primary line
4 Adapter
5 Contact plate
6 Fasteners
7 Contact element
8 Side wall
9 Adapter housing
10 Collective adapter housing
11 Bore
12 Circuit board
14 Voltage divider
15 Contact pins
16 Adapter cover
17 Transducer
18 Socket
19 Slot
20 Cushioned cam contact
21 Contact to the electronics module
22 Contact rods

The invention claimed is:

1. A circuit breaker, comprising:
a breaker housing;
an electronics module;
a contact element configured to tap a high voltage at a primary line; and
an adapter configured to reduce a tapped high voltage of the primary line to a low voltage for use in the electronics module, the adapter comprising an adapter housing, a circuit board disposed within the adapter housing, at least one voltage divider disposed on the circuit board, and a low-voltage contact configured to transmit the low voltage from the adapter to the electronics module,
wherein the adapter is provided inside the breaker housing,
wherein the adapter is positioned outside the electronics module,
wherein the adapter includes the contact element,
wherein the contact element includes a spiral-shaped compression spring,
wherein the spiral-shaped compression spring is fastened and connected to the circuit board of the adapter, and
wherein the spiral-shaped compression spring is preloaded against a surface of the primary line so as to transmit the high voltage from the primary line to the adapter.

2. The circuit breaker of claim 1, wherein the adapter is positioned in a side wall of the breaker housing.

3. The circuit breaker of claim 2, wherein the adapter is positioned in the side wall of the breaker housing through which the primary line is routed into the breaker housing.

4. The circuit breaker of claim 1, comprising a plurality of primary lines,
wherein the plurality of primary lines are assigned a corresponding number of adapters in a multi-pole circuit breaker.

5. The circuit breaker of claim 4, wherein each adapter includes a separate adapter housing.

6. The circuit breaker of claim 4, comprising a common collective adapter housing,
wherein a plurality of adapters is placed in a common collective adapter housing outside the electronics module.

7. The circuit breaker of claim 1, further comprising a slot,
wherein the primary line is inserted through the slot into a transducer,
a cushioned cam contact being provided at the slot so that permanent contact is established upon a sliding in of the primary line.

8. A circuit breaker, comprising:
a breaker housing;
an electronics module;
a contact element configured to tap a high voltage at a primary line; and
an adapter configured to reduce a tapped high voltage of the primary line to a low voltage for use in the electronics module, the adapter comprising an adapter housing, a circuit board disposed within the adapter housing, at least one voltage divider disposed on the circuit board, and a low-voltage contact configured to transmit the low voltage from the adapter to the electronics module, wherein the adapter is provided inside the breaker housing, wherein the adapter is positioned outside the electronics module, wherein the adapter includes the contact element, wherein the contact element includes a spiral-shaped compression spring, wherein the spiral-shaped compression spring is fastened and connected to the circuit board of the adapter, and wherein the spiral-shaped compression spring is preloaded against a mounting screw of the primary line so as to transmit the high voltage from the primary line to the adapter.

9. A circuit breaker, comprising:

a breaker housing;

an electronics module;

a contact element configured to tap a high voltage at a primary line; and an adapter configured to reduce a tapped high voltage of the primary line to a low voltage for use in the electronics module, the adapter comprising an adapter housing, a circuit board disposed within the adapter housing, at least one voltage divider disposed on the circuit board, and a low-voltage contact configured to transmit the low voltage from the adapter to the electronics module, wherein the adapter is provided inside the breaker housing, wherein the adapter is positioned outside the electronics module, wherein the adapter includes the contact element, wherein the contact element includes a spring-load contact fastened and connected to the circuit board of the adapter, and wherein one or more telescoping contact rods are preloaded by spring force against a surface of the primary line so as to transmit the high voltage from the primary line to the adapter.

10. A circuit breaker, comprising:

a breaker housing;

an electronics module;

a contact element configured to tap a high voltage at a primary line; and an adapter configured to reduce a tapped high voltage of the primary line to a low voltage for use in the electronics module, the adapter comprising an adapter housing, a circuit board disposed within the adapter housing, at least one voltage divider disposed on the circuit board, and a low-voltage contact configured to transmit the low voltage from the adapter to the electronics module, wherein the adapter is provided inside the breaker housing, wherein the adapter is positioned outside the electronics module, wherein the adapter includes the contact element, wherein the contact element includes a spring-load contact fastened and connected to a circuit board, and wherein one or more telescoping contact rods are preloaded by spring force against a mounting screw of the primary line so as to transmit the high voltage from the primary line to the adapter.

* * * * *